United States Patent [19]

Hemming

[11] 3,987,228

[45] Oct. 19, 1976

[54] PRODUCTION OF PILE SURFACED MATERIALS

[75] Inventor: Malcolm Hemming, Delamere, England

[73] Assignee: Imperial Chemical Industries Limited, London, England

[22] Filed: Feb. 27, 1975

[21] Appl. No.: 553,792

[30] Foreign Application Priority Data

Mar. 6, 1974 United Kingdom ..... 10044/74

[52] U.S. Cl. ..... 428/91; 264/88; 264/164; 264/171; 264/175; 264/284; 264/335; 428/92; 428/97

[51] Int. Cl.[2] ..... D06C 11/00; B32B 33/00

[58] Field of Search ..... 428/85, 91, 92, 913, 428/97; 264/47, 88, 164, 171, 175, 284, 335

[56] References Cited

UNITED STATES PATENTS

| | | | |
|---|---|---|---|
| 3,600,260 | 8/1971 | Watanabe | 428/92 |
| 3,708,565 | 1/1973 | Seiffert | 264/88 |

*Primary Examiner*—Marion E. McCamish
*Attorney, Agent, or Firm*—Cushman, Darby & Cushman

[57] ABSTRACT

A process of forming pile surfaced material comprising drawing fibrils from the surface of a cross-linkable thermoplastic material and cross-linking the thermoplastic while maintaining the fibrils in a self-supporting position.

16 Claims, No Drawings

PRODUCTION OF PILE SURFACED MATERIALS

The present invention relates to improvements in or relating to the production of pile surfaced materials. It is already known that pile surfaced materials may be produced from thermoplastic materials by pressing a sheet of the material against a heated surface so that at least the surface of the sheet is melted and sticks lightly to the surface. The sheet is then drawn away from the heated surface in such a way that fibrils are drawn out from the surface of the sheet. It has also been proposed that an improved pile may be obtained by cooling the fibrils as they are produced to ensure that they remain integral with the remainder of the thermoplastic material rather than adhering permanently to the heated surface.

It has been proposed that this fibril making process may be achieved by passing the plastic material between two belts one of which is heated, between a belt and a heated roll or between two rollers one of which is heated and the other cool. It has also been suggested that a backing material such as paper or a woven or non-woven fabric may be passed together with the sheet of thermoplastic material through such an apparatus with the thermoplastic material between the heated surface and the backing material. The thermoplastic is then melted by the heated surface and bonds more strongly to the backing material than it adheres to the surface so that the backing may be pulled away from the roll with the polymer adherent thereto so that fibrils of the polymer are drawn out due to its adhesion to the heated surface the fibrils remaining adherent to the backing. It has also been proposed that with certain materials the polymeric material may be cross-linked during fibril formation.

One problem that arises with products produced by such a process is that the abrasion resistance of the pile can be poor and at times the fibrils are too easily separated from the backing during use of the pile surfaced material. This is believed to be due to some extent to the low molecular weight of the polymer that it is necessary to use to obtain a satisfactory pile surface at commercially acceptable speeds.

It is an object of the present invention to overcome these disadvantages.

The present invention therefore provides a process for the production of pile surfaced material comprising interposing a cross-linkable thermoplastic material between a backing material and a surface heated to a temperature at which the thermoplastic adheres thereto, withdrawing the backing material from the heated surface with the thermoplastic adherent thereto so that the thermoplastic is drawn into fibrils between the surface and the backing material, rendering the fibrils self supporting and separating them from the heated surface and subsequently cross-linking the thermoplastic.

The present invention also provides pile surfaced material comprising fibrils of cross linked thermoplastic material bonded to a backing by means of the thermoplastic, including materials made by the abovementioned process.

It is important in the process of the present invention that the thermoplastic should not be cross-linked during fibril formation since with certain materials this can inhibit fibril formation. This invention is therefore concerned with cross-linking subsequent to fibril formation.

It is known that certain physical properties such as impact strength, tear strength, elongation to break and modulus of thermoplastics may be increased by cross-linking the polymer. However, there has been no suggestion that these techniques may be applied to pile surfaced materials to improve their abrasion resistance. In the fibre forming processes with which we are concerned the surface may be provided with cavities to aid fibril formation as is described in U.S. Pat. No. 3,600,260 or the surface may be a belt as described in British Pat. No. 1,139,165 or a roller as is shown in U.S. Pat. Nos. 3,701,621 and 3,708,565. We prefer that the heated surface be a roller, preferably a substantially smooth surfaced roller by which we mean a smooth, satin finished or matt surfaced roll without special cavities to define fibril shape as is described in our British Pat. Nos. 1,378,638; 1,378,639 and 1,378,640.

In our preferred process and the temperature of the heated surface is such that the thermoplastic is softened sufficiently to bond to the backing material although the thermoplastic may be prelaminated to the backing. The choice of backing material depends upon the use to which the product is to be put although examples of our preferred backings include paper and woven and non-woven fabrics.

Whichever of these processes we use we prefer that the fibrils are rendered self supporting by cooling the fibrils as they are formed as the thermoplastic separates from the heated surface. Cooling may be from the front for example by blowing cooling fluid into the nip formed as the thermoplastic moves away from the heated surface or by cooling from behind by withdrawing the material over a cooled bar and/or by blowing cooling fluid against the side of the foundation layer distant from the heated surface which, particularly with a porous foundation layer passes through the foundation layer into the fibril forming area. The cooling gas may be supplied through perforations in the cooled bar when one is used to aid withdrawal from the heated surface. A combination of front and back cooling of the type just described may also be used. The texture and length of pile may be determined by careful control of the angle at which the material is withdrawn from the heated surface and also the extent to which the pile is cooled as it is withdrawn from the surface as is described in Belgian Pat. No. 807,879. As is shown in this copending application the material is preferably withdrawn from the heated surface over a suitably shaped rod and although it is preferred to cool this rod at the point where the web contacts it on separation from the surface the rod may be so shaped that the web remains in contact with the rod for some distance after it leaves the hot roll and in this instance the part of the rod with which the web is in contact after it has left the heated surface may itself be heated which also achieves improved abrasion resistance of the pile.

The process of the present invention is applicable to all thermoplastic materials but the temperature of the hot surface used for pile formation depends upon the nature of the material. The choice of material will depend upon the use to which the pile surfaced material is to be put but we have found particularly pleasing products may be obtained using polymers and copolymers of olefines such as polyethylene, polypropylene, ethylene propylene copolymers, copolymers of ethylene and vinyl acetate and with polymers and copolymers of vinyl chloride, polymers and copolymers of styrene, polyesters such as polyethylene terephthalate and the various nylons together with any other well known thermoplastic materials.

The thermoplastic material may be such that it can be cross-linked under certain conditions or it may contain cross-linking agents which are not activated during fibril formation but may be activated late. The thermoplastic may come either direct from an extruder or from a reel of film. Alternatively the film may be formed by extrusion coating directly onto the backing material.

Examples of particularly suitable backing materials include woven and non-woven textile webs such as hesian, cotton net, glass fibre scrims and linen scrims alternatively the substrate may be paper or metal or cardboard and may have holes formed therein to aid adhesion between the substrate and the thermoplastic material.

The choice of cross-linking agent technique depends upon the nature of the polymer and the conditions under which cross-linking is to be effected. For example polyethylene may be cross-linked by electron-acceleration techniques without the addition of special cross-linking agents. Alternatively cross-linking agents may be used such as the type that is activated by heating although this is not preferred since the cross-linking agent should not be activated during pile formation and thus if it is heat activated it should have a higher activation temperature than the temperature used for pile formation. However, the pilous nature of the product is sometimes damaged by heating to temperatures above the polymer softening point and thus we prefer not use heat activated cross-linking agents. Alternatively, the cross-linking agent may be activated by irradiation although this is also not preferred since the operating conditions are both dangerous and expensive. We therefore prefer to use cross-linking agents which are photo-activated by, for example ultraviolet light.

Examples of suitable photo-initiated cross-linking agents include mixtures of photo-initiators and polyfunctional cross-linking agents. Examples of suitable initiators are aromatic carbonyl compounds such as xanthone, dextro or laevo camphorquinone, 2 methyl anthraquinone or 4,4′ dichloromethyl benzophenone. Examples of suitable polyfunctional cross-linking agents include polyallyl or polyvinyl compounds such as triallyl cyanurate, diallyl sebacate, tetrallyl pyromellitate, triallyl phosphate, divinyl benzene and trivinyl benzene. These mixtures of compounds have been found particularly useful for cross-linking pilous polyolefines such as polyethylene but they may also be used with other polymers such as polyvinyl chloride, polyesters such as polyethylene terephthalate and polyamides.

The quantities of the cross-linking materials that should be used are the normal quantities employed for cross-linking for example up to 1 percent by weight of the polymer of photo-initiator may be used together with up to 5 percent preferably up to 1 percent by weight of the polymer of the polyfunctional cross-linking agent. The cross-linking materials are preferably incorporated into the bulk polymer as a masterbatch. When using photo-initiated cross-linking systems of the type described above, cross-linking may be achieved by iradiating the pile surface product with visible or ultraviolet light of wavelength in the range 200 to 700 $\times 10^{-9}$ meters for up to 1 hour, the material being held at a temperature below that of pile formation. Where radiation is used to cross-link polymers without cross-linking agents we prefer to use electron accelerators giving a dose in the range 5 to 30 megarads.

We have found that the techniques of the present invention enable improved materials to be obtained from polymers of the molecular weight most suited to the production of pile surfaced materials by processes of the type described above. The effect of cross-linking had been found to decrease the melt flow index of the polymer in the finished product which improves the abrasion resistance of the pile surface. In addition, the solubility of the polymer in certain solvents is reduced, the dimensional stability of the polymer at temperatures around its melting point is improved which has particular advantages in producing materials laminated to a backing since it allows the material to be heated to improve adhesion to the backing. The polymer may also more readily be heated during subsequent fabrication such as during vacuum forming. In addition to resistance of the material to boiling water is increased as is the resistance to stress cracking when subjected to detergents which facilitates cleaning. The pile itself is also stiffer and more resilient which is most useful in protective packaging and wall and floor covering outlets.

Other advantages of our techniques are that part of the surface of the pile surfaced material may be masked during photo-cross-linking to prevent certain areas cross-linking. Since cross-linking raises the melting point of the polymer the uncross-linked areas will have a lower melting point and thus by heating the material to a temperature between the melting points of the cross-linked and uncross-linked polymer an embossed effect may be obtained due to the melting and shrinking of only the uncross-linked regions.

The present invention is illustrated but in no way limited by reference to the following examples some of which are included for the purposes of comparison.

EXAMPLE 1

A film of low density polyethylene about 80 microns thick was fed at a speed of 1 meter per minute to the surface of a roll heated to 160° C together with a paper backing, the polyethylene was between the roll surface and the backing. The two materials passed together around the surface of the roll so that the polyethylene was melted and bonded to the paper backing. The laminate thus formed was withdrawn from the heated surface over an internally cooled metal rod so that the polyethylene was drawn into fibrils due to its weak adhesion to the roll surface, these fibrils were cooled as they formed by directing a jet of cold air between the roll and the polymer as they separate from each other.

The first sample of film contained no cross-linking agents, the second sample contained 0.2 percent by weight of xanthone and 2 percent by weight of triallyl cyanurate. Three samples of the second material were taken, the first unirradiated, the second was subjected to a Thorn 400 watt blue light for 40 minutes, the third consisted of the second sample heated for 5 minutes.

The abrasion resistance of each sample was measured by the Taber test and the results were as follows.

| Sample | Test Result |
|---|---|
| 1 | 50 |
| 2 | 60 |
| 3 | 700 |

-continued

| Sample | Test Result |
|---|---|
| 4 | 500 |

According to the Taber test a circular sample of the product is clamped pile side uppermost on a rotating disc with two weights each of 250 grams bearing down on diammetrically opposed parts of the pile surface, the weights being at the same distance from the centre of the circular sample. The disc is then rotated and the test result is the number of rotations of the sample to produce a visible deterioration in the pile structure.

I claim:

1. A process for the production of pile surfaced material comprising interposing a cross-linkable thermoplastic material between a backing material and a surface heat to a temperature at which the thermoplastic adheres thereto, withdrawing the backing material from the heated surface with the thermoplastic adherent thereto so that the thermoplastic is drawn into fibrils between the surface and the backing material, rendering the fibrils self supporting and separating them from the heated surface and subsequently cross-linking the thermoplastic while maintaining the fibrils self-supporting.

2. A process according to claim 1 in which the heated surface is a roller having a substantially smooth surface as hereinbefore described.

3. A process according to claim 1 in which the thermoplastic and the backing material are fed separately to the heated surface whose temperature is such that the thermoplastic is melted and bonds to the backing.

4. A process according to preceding claim 1 in which the fibrils are rendered self supporting by cooling and solidification of the thermoplastic material and in which the material is maintained solid during the cross-linking step.

5. A process according to claim 4 in which the cooling is achieved by a stream of cold gas.

6. A process according to claim 5 in which the stream of cold gas is directed against the side of the backing material remote from the heated surface and passes through the backing into the fibril forming area.

7. A process according to claim 1 in which the thermoplastic contains a cross-linking agent which is not activated during pile formation but may be activated after pile formation to cross-link the thermoplastic.

8. A process according to claim 7 in which the cross-linking agent is photo-activated.

9. A process according to claim 8 in which the cross-linking agent is a mixture of a photo-initiator and one or more polyfunctional cross-linking agents.

10. A process according to claim 9 in which the thermoplastic contains up to 1 percent by weight of the thermoplastic of the photo-initiator and up to 5 percent by weight of the thermoplastic of the cross-linking agent.

11. A process according to claim 1 in which the thermoplastic is cross-linked by exposure to ultra-violet light.

12. A process according to claim 1 in which the thermoplastic is cross-linked by exposure to high energy irradiation.

13. A process according to claim 12 in which the high energy irradiation is from an electron accelerator giving a dose in the range 5 to 30 megarads.

14. A process according to claim 1 in which only certain areas of the pile are cross-linked.

15. A process according to claim 14 in which those areas of pile which are not to be cross-linked are masked during radiation cross-linking.

16. A pile surfaced material made by the process of claim 1.

* * * * *